US010213670B2

(12) United States Patent
Adams

(10) Patent No.: US 10,213,670 B2
(45) Date of Patent: Feb. 26, 2019

(54) SPORT GOAL TRAINING APPARATUS

(71) Applicant: Richard J. Adams, Charlestown, MA (US)

(72) Inventor: Richard J. Adams, Charlestown, MA (US)

( * ) Notice: Subject to any disclaimer, the term of this patent is extended or adjusted under 35 U.S.C. 154(b) by 0 days.

(21) Appl. No.: 15/723,838

(22) Filed: Oct. 3, 2017

(65) Prior Publication Data

US 2018/0099196 A1 Apr. 12, 2018

Related U.S. Application Data

(60) Provisional application No. 62/405,112, filed on Oct. 6, 2016.

(51) Int. Cl.

| | |
|---|---|
| ***A63B 69/00*** | (2006.01) |
| ***A63B 63/00*** | (2006.01) |
| ***A63B 71/06*** | (2006.01) |
| *A63B 102/34* | (2015.01) |
| *A63B 102/14* | (2015.01) |

(52) U.S. Cl.

CPC ..... *A63B 69/00* (2013.01); *A63B 63/004* (2013.01); *A63B 69/002* (2013.01); *A63B 69/0024* (2013.01); *A63B 69/0026* (2013.01); *A63B 69/0071* (2013.01); *A63B 71/0605* (2013.01); *A63B 2102/14* (2015.10); *A63B 2102/34* (2015.10); *A63B 2220/17* (2013.01); *A63B 2225/20* (2013.01); *A63B 2225/50* (2013.01)

(58) Field of Classification Search

CPC ..... A63B 69/00; A63B 63/004; A63B 69/002; A63B 69/0024; A63B 69/0026; A63B 69/0071; A63B 71/0605; A63B 2102/14; A63B 2102/34; A63B 2220/17; A63B 2225/20; A63B 2225/50

USPC ..... 473/422, 434, 435, 439, 446, 454–456, 473/476–478; 273/400–402, 398, 389, 273/354, 392; D21/698–699, 722, 780, D21/787–789

See application file for complete search history.

(56) References Cited

U.S. PATENT DOCUMENTS

| | | | | | |
|---|---|---|---|---|---|
| 2,657,058 | A | | 10/1953 | Mulcahy | |
| D205,040 | S | | 6/1966 | Bruns | |
| 3,328,033 | A | | 6/1967 | Hendry | |
| 3,856,298 | A | | 12/1974 | Frantti | |
| 3,887,181 | A | * | 6/1975 | Samaras | A63B 63/00 473/446 |
| 4,142,717 | A | * | 3/1979 | Monaco | A63B 63/00 473/453 |
| 4,168,062 | A | * | 9/1979 | McCarthy | A63B 63/06 473/446 |

(Continued)

*Primary Examiner* — Mitra Aryanpour

(74) *Attorney, Agent, or Firm* — Adam P. Daniels, Esq.; Polsinelli LLP

(57) ABSTRACT

A training apparatus includes a panel that forms an obstruction proximate an entrance plane of a goal. The panel has one or more apertures that permit an object passage through the entrance plane of the goal. The training apparatus also includes a rotary assembly coupled to the panel and one or more doors in operable communication with the rotary assembly. The rotary assembly has an axis of rotation and at least one arm that rotates there-about. Each door is located proximate a respective aperture and movable between a closed position and an open position based on motion by the rotary assembly.

19 Claims, 10 Drawing Sheets

(56) References Cited

U.S. PATENT DOCUMENTS

| | | | | | |
|---|---|---|---|---|---|
| 4,842,283 | A * | 6/1989 | LeBel | A63B 63/004 | 473/478 |
| 5,000,461 | A | 3/1991 | Borazjani | | |
| 5,238,243 | A * | 8/1993 | Grispi | A63B 63/00 | 473/446 |
| D352,326 | S | 11/1994 | Hsiao | | |
| 5,367,503 | A | 11/1994 | Lowrance | | |
| 5,509,650 | A * | 4/1996 | MacDonald | A63B 24/0021 | 473/446 |
| 5,582,404 | A * | 12/1996 | Parzino | A63B 69/0024 | 473/446 |
| 5,833,234 | A | 11/1998 | Vavala et al. | | |
| 6,155,936 | A | 12/2000 | Dorr | | |
| 6,223,801 | B1 | 5/2001 | Mitchell | | |
| 6,739,988 | B2 | 5/2004 | Jensen et al. | | |
| 6,846,253 | B1 | 1/2005 | Szwalek | | |
| 7,762,912 | B2 * | 7/2010 | Lewis | A63B 69/0002 | 473/422 |
| 8,246,494 | B2 | 8/2012 | Stephenson | | |
| 8,529,382 | B2 * | 9/2013 | Green | A63B 63/00 | 473/454 |
| 8,590,901 | B2 | 11/2013 | Goldwitz | | |
| 8,602,919 | B2 * | 12/2013 | Bishop | A63B 63/00 | 473/421 |
| 8,678,957 | B1 | 3/2014 | Essex | | |
| 8,961,339 | B2 | 2/2015 | Littman et al. | | |
| D742,466 | S | 11/2015 | Jaguan | | |
| 9,427,645 | B1 | 8/2016 | Salscheider | | |
| D806,812 | S * | 1/2018 | Adams | D21/699 | |
| 2003/0030218 | A1 | 2/2003 | Zucchi et al. | | |
| 2006/0089213 | A1 | 4/2006 | Snyder | | |
| 2008/0312011 | A1 | 12/2008 | Edmondson | | |
| 2013/0023362 | A1 | 1/2013 | Siefker | | |
| 2014/0045628 | A1 | 2/2014 | Krohl et al. | | |
| 2016/0016060 | A1 | 1/2016 | Goldwitz | | |
| 2016/0289998 | A1 | 10/2016 | Huang | | |
| 2017/0189773 | A1 | 7/2017 | Cho | | |
| 2018/0099196 | A1 * | 4/2018 | Adams | A63B 69/00 | 473/446 |

* cited by examiner

SPORT GOAL TRAINING APPARATUS

CROSS REFERENCE TO RELATED APPLICATION

This application claims priority to U.S. Provisional Patent Application No. 62/405,112, filed on Oct. 6, 2016, the content of which is herein incorporated by reference.

TECHNICAL FIELD

The present disclosure relates generally to training devices or aids for developing sporting skills. More particularly, the present disclosure relates to a goal training devices suitable for developing skills in sports where points are awarded when balls, pucks, or other objects pass into a goal of an opposing team.

BACKGROUND

In many sports involving a goal, hoop, net, or the like, a team is awarded points by passing a ball, puck, or other object into a goal of an opposing team. Outside of actual game play, individuals or players typically hone important skills by shooting the ball, puck, or other object into an empty goal or net. However, practicing or shooting into an empty goal or net does not adequately simulate live game situations where an opposing team attempts to block or otherwise prevent a successful shot. Moreover, a player may develop bad habits or become complacent without the benefit of another player attempting to block a shot. Although practicing in simulated live game situations (e.g., scrimmages) improves overall player development, coordinating amongst other players to and/or finding available time at proper facility (e.g., field, rink, etc.) often proves difficult. Instead, many players practice by themselves with the empty net, without the benefit of dynamic live game play.

BRIEF DESCRIPTION OF THE DRAWINGS

The embodiments herein may be better understood by referring to the following description in conjunction with the accompanying drawings in which like reference numerals indicate identical or functionally similar elements. Understanding that these drawings depict only exemplary embodiments of the disclosure and are not therefore to be considered to be limiting of its scope, the principles herein are described and explained with additional specificity and detail through the use of the accompanying drawings in which.

DESCRIPTION OF EXAMPLE EMBODIMENTS

Overview

According to one or more embodiments of the disclosure, a training apparatus (e.g., a goal training aid, etc.) includes a panel that forms an obstruction proximate an entrance plane of a goal. Notably, the panel includes one or more apertures that permit an object passage through the entrance plane of the goal. In addition, the training apparatus also includes a rotary assembly coupled to the panel. The rotary assembly has an axis of rotation and at least one arm that rotates about the axis of rotation. Moreover, the training apparatus also has one or more doors (e.g., "blockers") in operable communication with the arm (or arms) of the rotary assembly, where each door is typically located proximate a respective aperture. The doors are moveable between a closed position and an open position. In the closed position, the doors prevent passage of the object through the entrance plane of the goal (e.g., blocking the object) and in the open position, the doors permit passage of the object through respective apertures, and thus through the entrance plane of the goal (e.g., an open target area/aperture).

Description

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

As discussed, many sports involve a goal (or hoop, net, etc.) and have a score system that awards points when an object (e.g., a puck, ball, etc.) pass through an opening of the goal. Practicing for such sports without a defender and/or practicing with unobstructed access to the goal may help a player develop some basic skills; however, it does not accurately simulate the dynamic nature of live game situations. Accordingly, the subject embodiments disclosed herein describe a training or practice aid that dynamically blocks (and unblocks) access to the entrance of a goal, hoop, net, and the like. As discussed in greater detail herein, the training or practice aid is described and illustrated in particular context (e.g., hockey), but it is appreciated the training or practice aid may be readily adapted for any type of sport or contest involving a goal (e.g., soccer goal, basketball goal/hoop, water polo goal, field hockey goal, lacrosse goal, and the like).

Figure 1:
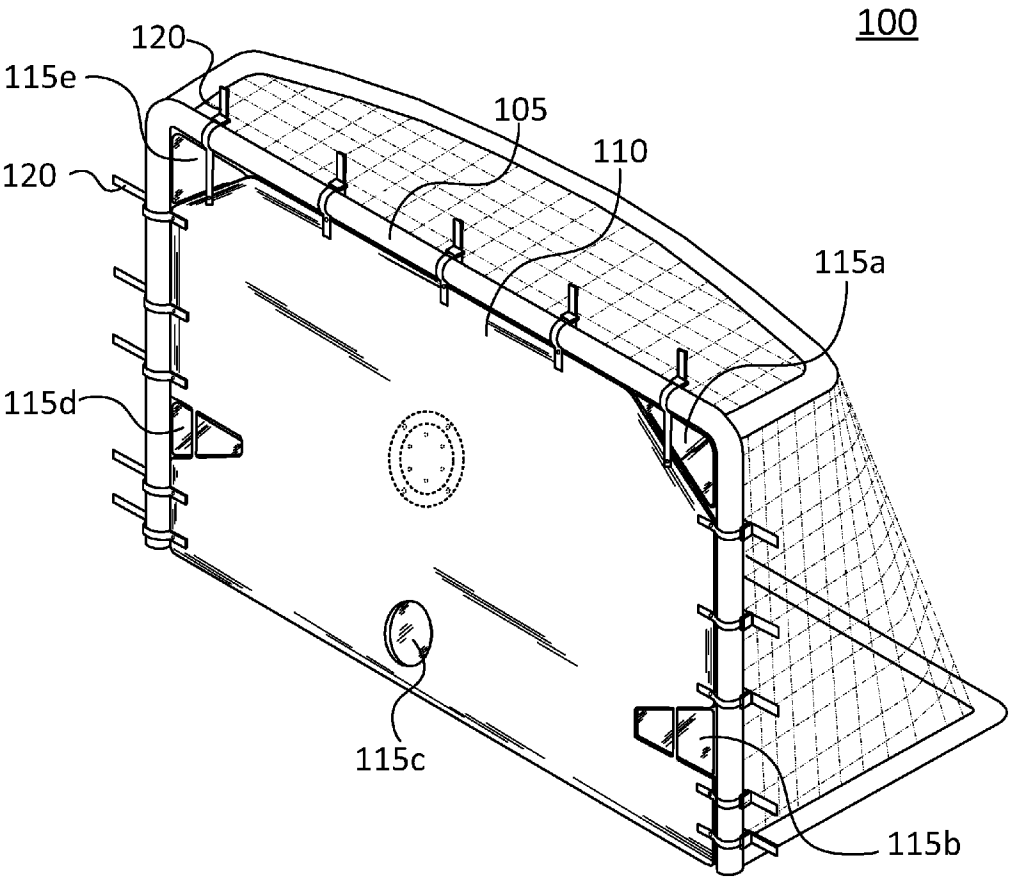
FIG. 1 illustrates a perspective isometric view of a goal training apparatus according to one embodiment of this disclosure, generally viewed from a front side.

For example, referring to the figures, FIG. 1 illustrates a perspective isometric view of a goal training apparatus 100 according to one embodiment of this disclosure. As shown, goal training apparatus 100 is generally viewed from a front side, with goal training apparatus 100 attached to a goal or goal frame 105 near its opening (e.g., proximate an entrance plane of the goal).

Goal training apparatus 100 includes a front panel 110 that forms a barrier or obstruction proximate the goal opening or proximate the entrance plane of the goal. As shown, front panel 110 is positioned proximate the entrance plane of the goal using one or more fasteners 120 located about a perimeter of front panel 110. Fasteners 120 may include be straps (as shown) that releasably secure, couple, and/or mount front panel 110 to goal frame 105. Operatively, fasteners 120 loop around goal frame 105 and secure to portions of front panel 110 using, for example, a screw, bolt, pin, thread, cam-lock, or the like.

Goal training apparatus 100 also includes one or more doors or blockers, which are generally labeled with a reference number 115, including doors 115*a*, 115*b*, 115*c*, 115*d*, and 115*e*. Here, doors 115 are coupled to a backside of front panel 110, with each door 115 located proximate a respective aperture defined by front panel 110, as discussed below.

Figure 2:
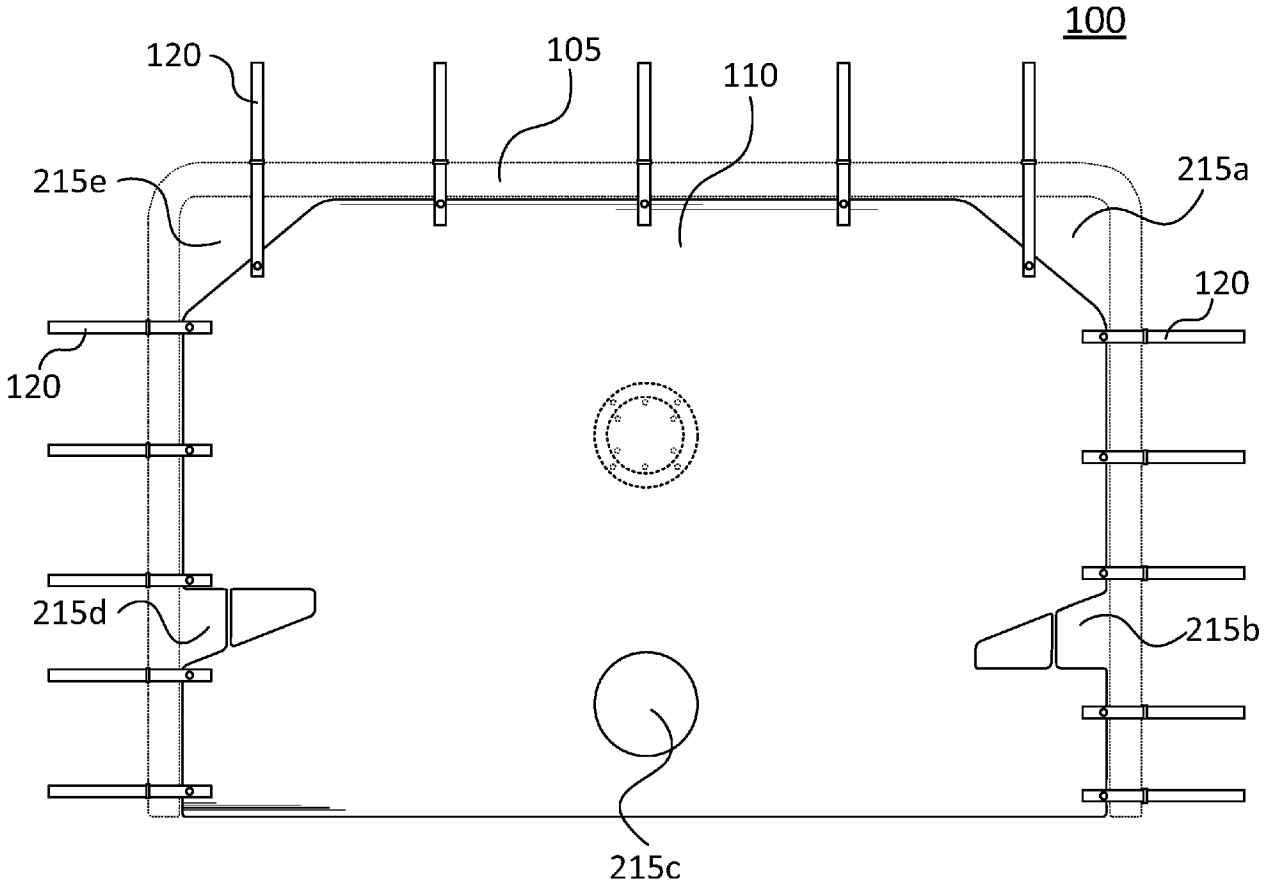
FIG. 2 illustrates a front side elevation view of the goal training apparatus shown in FIG. 1, showing apertures defined by a front panel of the goal training apparatus.
Figure 3:
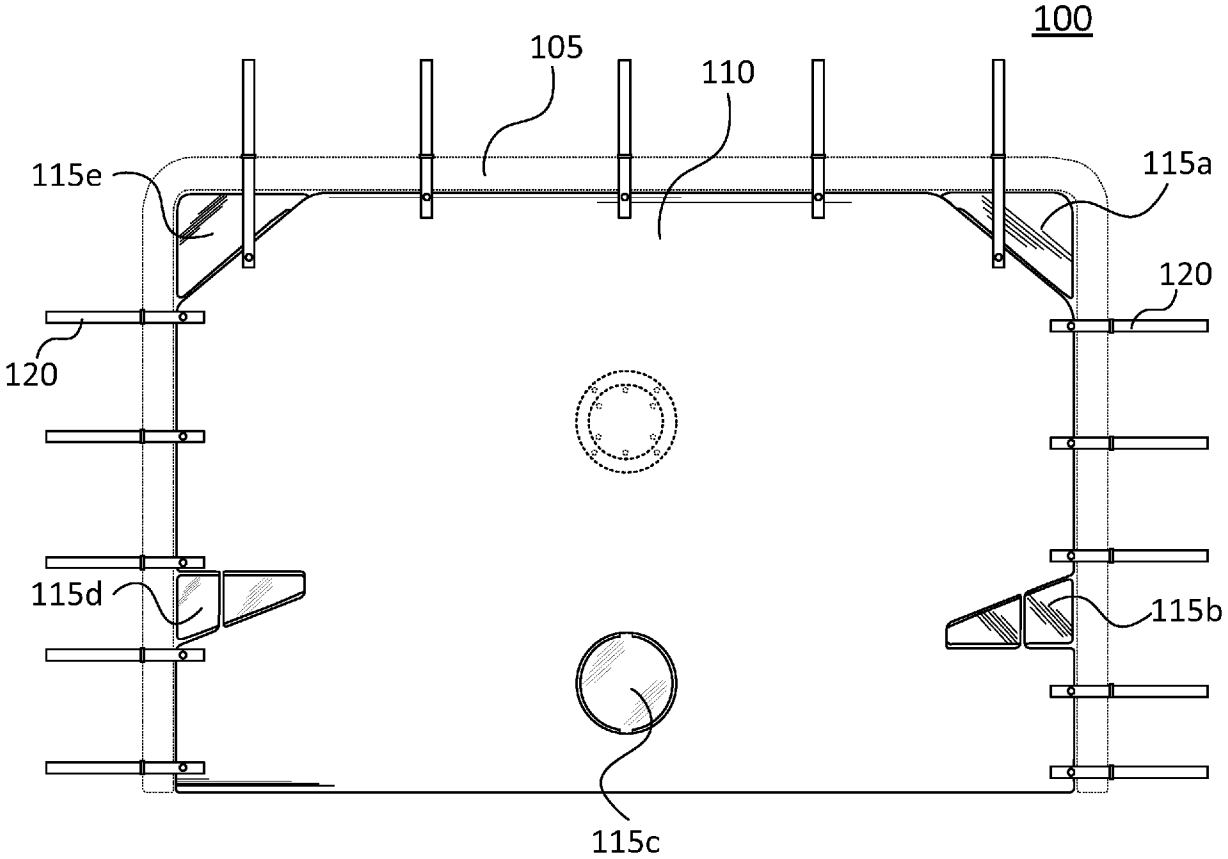
FIG. 3 illustrates the front side elevation view of the goal training apparatus shown in FIG. 2, showing doors obstructing respective apertures.

FIGS. 2 and 3 illustrate front side elevation views of goal training apparatus 100, showing apertures 215 (FIG. 2) and doors 115 (FIG. 3) obstructing respective apertures. Referring to FIG. 2, front panel 110 defines one or more apertures, generally labeled with a reference number 215, which include apertures 215*a*, 215*b*, 215*c*, 215*d*, and 215*e*. Notably, some apertures, e.g., apertures 215*a*, 215*e*, and portions of apertures 215*b*, 215*d*, are defined with respect to goal frame 105, while other apertures, including apertures 215*c* (and other portions of apertures 215*b*, 215*d*) are defined (as a whole) by front panel 110 only. That is, aperture 215*a* forms an opening between front panel 110 and goal frame 105 such that an object can pass through aperture 215*a* and through the entrance plane of the goal (and into a net, as appropriate). In comparison, aperture 215*c* forms an opening or hole through front panel 110 (only) such that an object can pass through aperture 215*c* (e.g., through front panel 110) and through the entrance plane of the goal. Similarly, apertures 215*b* and 215*d* include portions defined with respect to goal frame 105 as well as portions defined entirely by front panel 110. Thus, as used herein, the term aperture refers to openings in a panel (e.g., front panel 110) as well as openings, holes, or spaces created between the panel and a goal frame (e.g., frame 105). In addition, as shown, one or more fasteners 120 can also obstruct a portion of corresponding apertures to increase the level of difficulty of scoring a goal —e.g., portions of apertures 215*e* and 215*a* are obstructed by corresponding fasteners 120.

Referring to FIG. 3, each door 115 is located or positioned proximate a respective aperture 215. For example, door 115*a* is located proximate aperture 215*a*, door 115*b* is located proximate aperture 215*b*, and so forth. In operation, each door 115 is movable between an open position and a closed position, as illustrated by FIGS. 2 and 3, respectively. In the open position (FIG. 2), a portion of each door 115 moves away from its respective aperture 215 to permit passage by object through the respective aperture 215. In contrast, in the closed position (FIG. 3), the portion of each door 115 moves toward its respective aperture 215 to block or obstruct passage by the object to the respective aperture 215. For example, an object such as a puck, will strike the portion of the door blocking the respective aperture 215, instead of passing through into the goal. In this fashion, each door can operatively "open" and "close" to permit or prohibit access by an object through the entrance plane of the goal.

Figure 4:
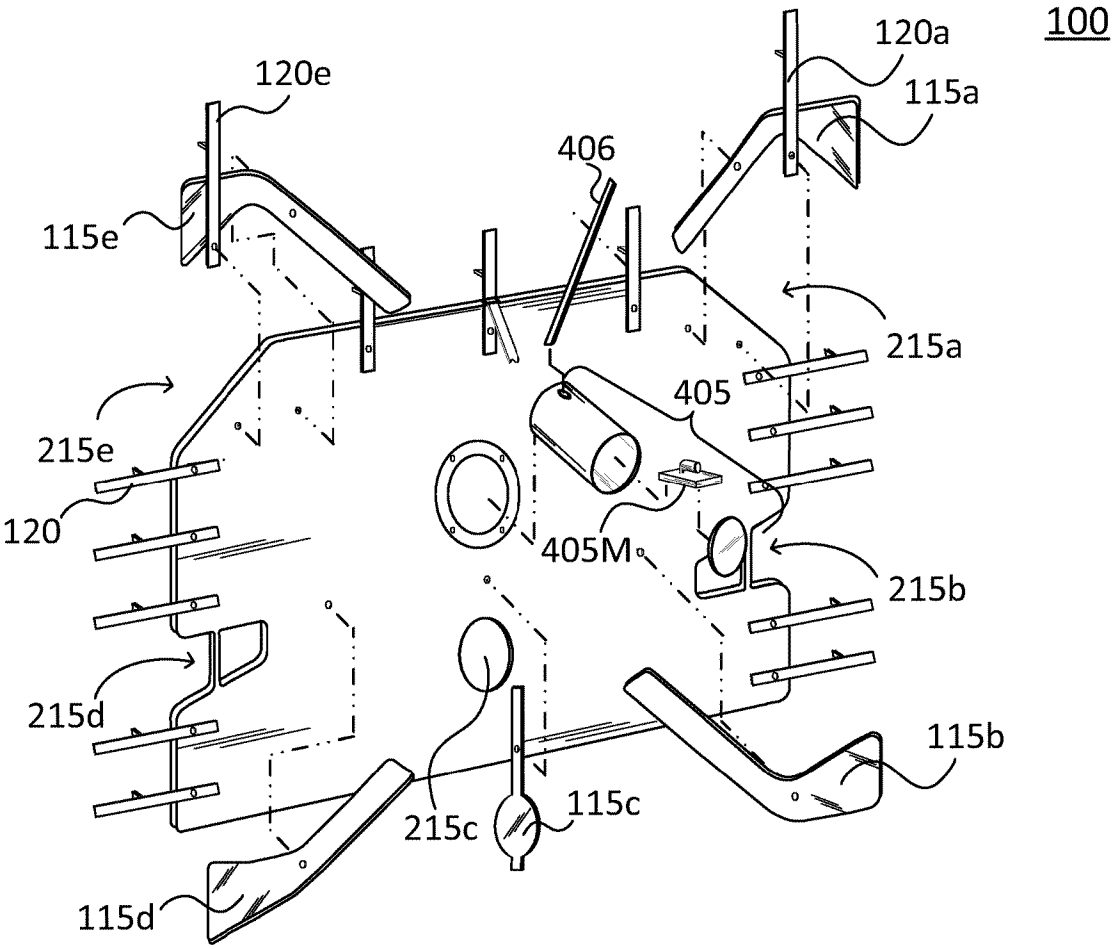
FIG. 4 illustrates an exploded perspective isometric view of the goal training apparatus shown in FIG. 1, generally viewed from a back side, opposite the front side.

FIG. 4 illustrates an exploded perspective isometric view of goal training apparatus 100, generally viewed from its back side. As discussed above, each door 115 is coupled to front panel 110 proximate a respective aperture 215. For example, the doors 115 may be couple to front panel 110 using a fastener mechanism such as a bolt, screw, pin, and the like. As shown, the fastener-mechanism for each door 115 further forms a respective axis of rotation that permits each door to rotate and thus move between its open and close position.

As shown, goal training apparatus 100 also includes a rotary assembly 405 coupled to a backside of front panel 110. Rotary assembly 405 includes a motor 405M, which turns an arm 406 about a rotary assembly axis of rotation. Preferably, rotary assembly 405 is coupled to a central portion of front panel 110 so that arm 406 contacts at least a portion of each door 115 during its rotation to cause each door 115 to swing or rotate into the open position, thus unblocking the respective aperture. Alternatively, rotary assembly 405 may include multiple arms as well as various shapes for its arms. Notably, in embodiments with multiple arms, each arm may be configured to rotate at a different speed (e.g., gear ratios, etc.).

In operation, rotary assembly 405 simulates the dynamic nature of live game situations and can causes each door 115 to open at different times. For example, rotary assembly 405 may rotate its arm 406 on a random schedule, a preprogrammed schedule, and/or a custom schedule. Further, as discussed, rotary assembly 405 can include a number of arms that cause multiple doors 115 to open at the same time.

In addition, FIG. 4 also shows door 115*a* and door 115*e* disposed between a fastener 120*a* and 120*e* and front panel 110, respectively. Here, fastener 120*a* and fastener 120*e* releasably secure front panel 110 to goal frame 105 (not shown), and additionally provide structural support for an associated door—here, door 115*a* and door 115*e*. Specifically, fastener 120*a* and fastener 120*e* prevent flexion by their respective doors caused by an object strike. For example, when an object strikes door 115*a*, door 115*a* absorbs the energy and may bend or flex. Fastener 120*a* serves as a buttress or bulwark for door 115*a* and absorbs the energy from door 115*a* so as to prevent door 115*a* from bending or flexing. The additional structural support afforded by fastener 120*a* and 120*e* may help reduce an overall weight and/or stiffness for doors 115*a* and 115*e*.

Similar to the structural support provided by fastener 120*a*, 120*e*, front panel 110 also includes a lattice or an interlace pattern for apertures 215*b*, 215*d*. Here, the lattice or interlace pattern forms a strip that divides aperture 215*b*, 215*d* into two different sections. This lattice or interlace pattern form a front-facing structure (e.g., in front of doors 115*b*, 115*d* relative to the entrance plane of the goal) that absorbs energy from an object strike. Notably, other embodiments may employ a combination of fasteners 120*a*, 120*e* in conjunction with one or more lattices or interlace patterns 215*b*, 215*d*.

Figure 5:
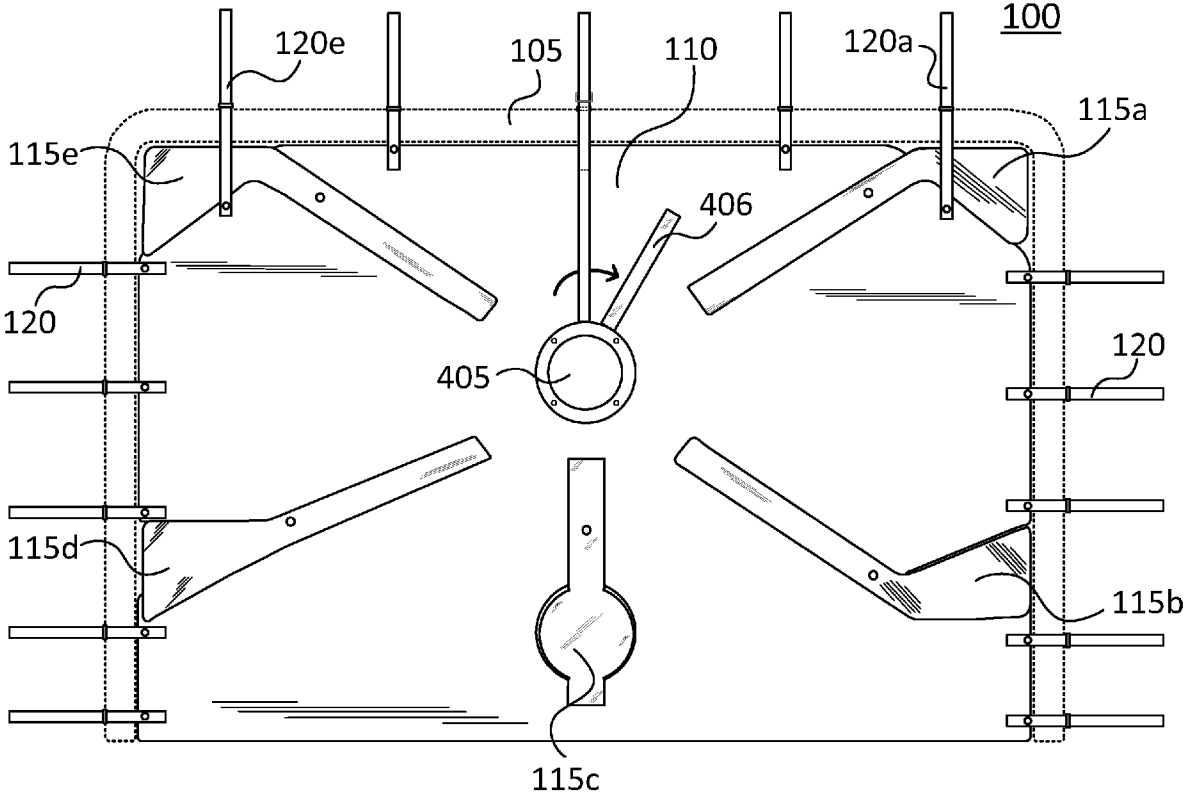
FIG. 5 illustrates a back side elevation view of the goal training apparatus shown in FIG. 1.
Figure 6:
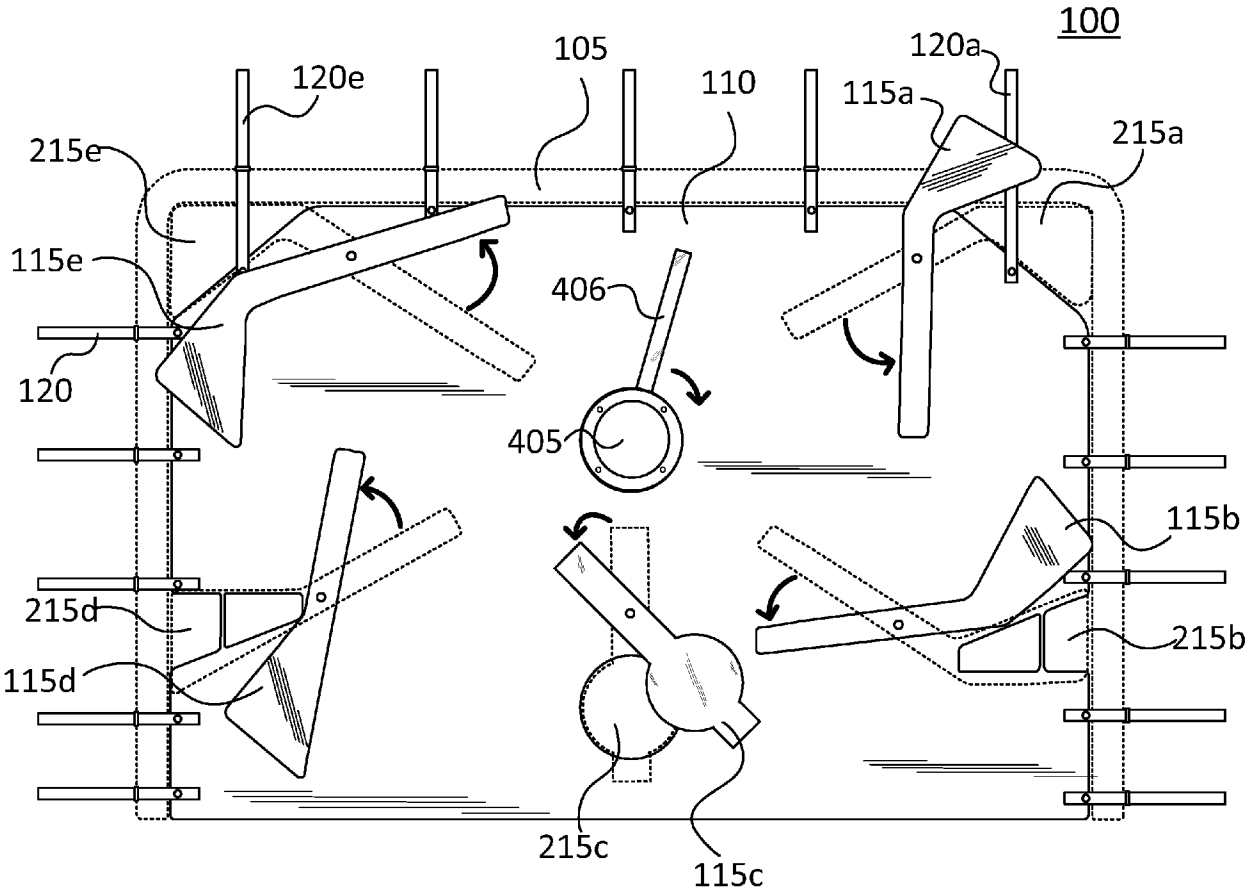
FIG. 6 illustrates the back side elevation view of the goal training apparatus shown in FIG. 5, showing movement of the doors between an open position and a closed position.

FIG. 5 and FIG. 6 illustrate back side elevation views of goal training apparatus 100, showing motion or movement of doors 115 between closed positions (FIG. 5) and open positions (FIG. 6). Notably, FIG. 5 generally illustrates a backside elevation view that corresponds to the front side elevation view shown in FIG. 3, while FIG. 6 generally illustrates a backside elevation view that corresponds to the front side elevation view shown in FIG. 2.

In operation, rotary assembly 405 rotates arm 406 about its axis of rotation, which causes arm 406 to contact a portion of each door 115. In this fashion, arm 406 is in operable communication with each door 115. As each door 115 is contacted by arm 406, the door rotates about its axis of rotation and generally moves away from its respective aperture which allows an object unobstructed (or unhindered) access through front panel 110 and through the entrance plane. In this fashion, rotary assembly 405 "opens" each door 115.

Notably, in preferred embodiments, each door 115 includes a certain weight ratio and/or a counterbalance mass that returns doors to one or either its open position or closed position. For example, while the above operations describe each door 115 opening upon contact by arm 406, each door 115 may return to the closed position after contact due to its weight ratio and/or counter balance mass. Alternatively (and/or in addition) one or more springs may be disposed in operable communication with one or more doors 115 to return the respective door to its closed position or an open position. Moreover, in some embodiments, each door 115 may default or rest in an open position and move into a closed position due to contact by arm 406 or vice versa.

Figure 7:
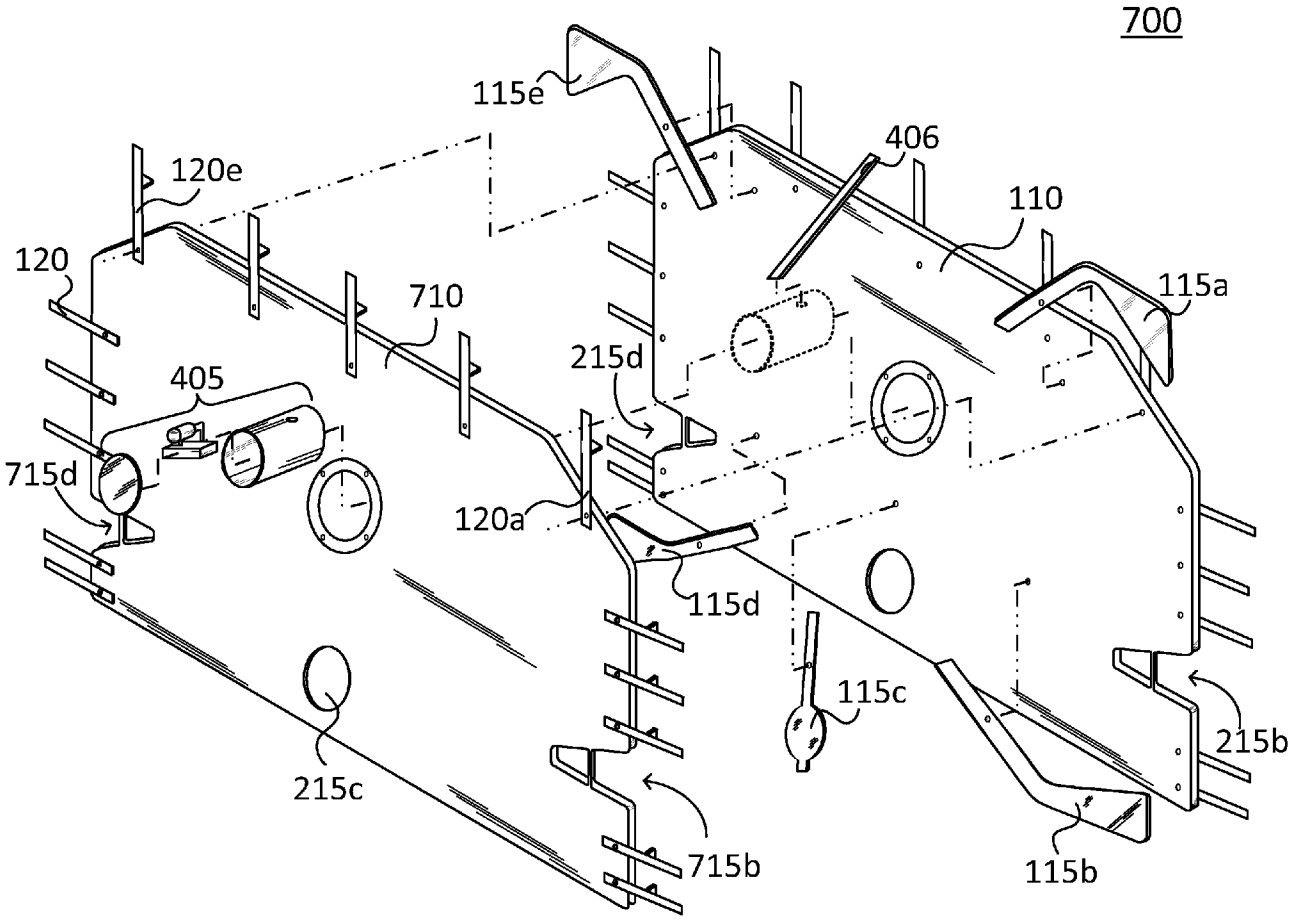
FIG. 7 illustrates an exploded perspective isometric view of a goal training apparatus according to another embodiment of this disclosure, generally viewed from a back side.

FIG. 7 illustrates an exploded perspective isometric view of a goal training apparatus 700 according to another embodiment of this disclosure, generally viewed from a back side. As shown, goal training apparatus 700 shares many features with goal training apparatus 100, discussed above. However, here, goal training apparatus 700 includes a second panel or back panel 710, which couples to front panel 110 as well as to goal frame 105 (not shown). Back panel 710 includes a substantially similar (and/or the same) design as front panel 110, including substantially similar apertures generally referenced by 715. Preferably, back panel 710 mates with front panel 110 and functionally sandwiches doors 115 between the panels. Put differently, front panel 110 and back panel 710 can be coupled together (e.g., by fasteners, screws, bolts, pins, threads, cam-locks, or the like) with doors 115 disposed there-between. For example, front panel 110 and back panel 710 may each have integrated fasteners (e.g., sewn into and/or attached to the panel) that mate together using a cam-lock. One or both of the respective integrated fasteners may loop over a structural support (e.g., a cross bar) of the goal (not shown) and operatively fasten or couple front panel 110 and back panel 710 to the goal and/or operatively fasten or couple front panel 110 to back panel 710.

In addition, back panel 710 generally protects and covers the underlying mechanics (e.g., doors 115, arm 406, and the like) of goal training apparatus 700 and may also provide additional structural support. For example, back panel 710 includes a substantially similar (and/or the same) lattice or an interlace pattern for apertures 715*b*, 715*d* as for corresponding apertures 215*b*, 215*d* (defined by front panel 110). Here, the lattice or interlace pattern for apertures 715*b*, 715*d* is defined by back panel 710 and includes a strip that divides apertures 715*b*, 715*d* into two different sections. Further, the lattice or interlace pattern also provides a rear support (e.g., buttress) that prevents doors 115*b*, 115*d*, respectively, from flexing or bending upon object strike. In this fashion, the lattice or interlace pattern defined by back panel 710 operates similar to fastener 120*a*, 120*e* and absorbs the energy from and object striking door 115*a*, 115*e* and further prevent door flexion. Optionally, additional fasteners may be employed with front panel 110 and/or back panel 710 in conjunction with the respective lattice/interlace patterns.

Further, as shown, rotary assembly 405 is coupled to back panel 710, with a portion (shown in dash lines) extending through back panel 710 toward front panel 110 such that arm 406 is disposed between back panel 710 and front panel 110. While the rotary assembly 405 may be coupled to front panel (as described above), here, rotary assembly 405 is coupled to back panel 710. Alternatively, rotary assembly may couple to portions of both back panel 710 and front panel 110.

Figure 8:
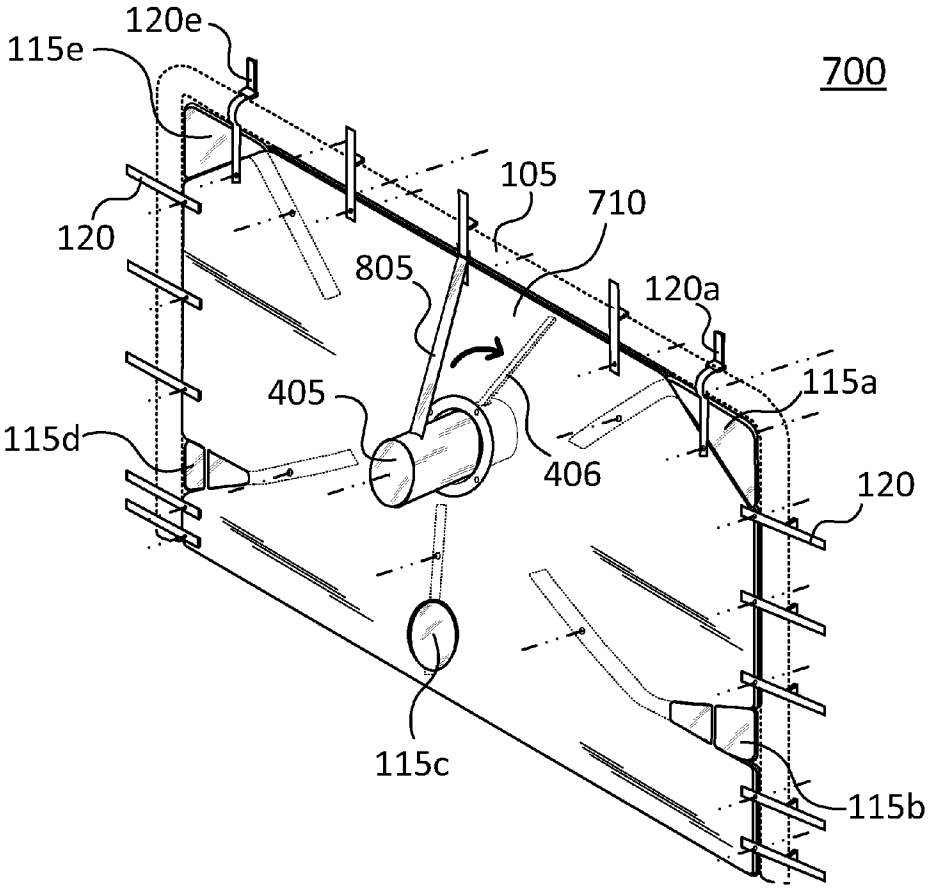
FIG. 8 illustrates a perspective isometric view of a goal training apparatus shown in FIG. 7, generally viewed from the back side.

FIG. 8 illustrates a perspective isometric view of goal training apparatus 700, showing the underlying mechanics such as doors 115 and arm 406 covered and/or protected by back panel 710. Additionally, as shown, goal training apparatus 700 may include a support strap 805, which couples a portion of rotary assembly 405 to goal frame 105. In this fashion, support strap 805 distributes a portion of the overall load or weight carried of rotary assembly 405 to goal frame 105, thereby reducing the load carried by front panel 110 and/or back panel 710.

Figure 9:
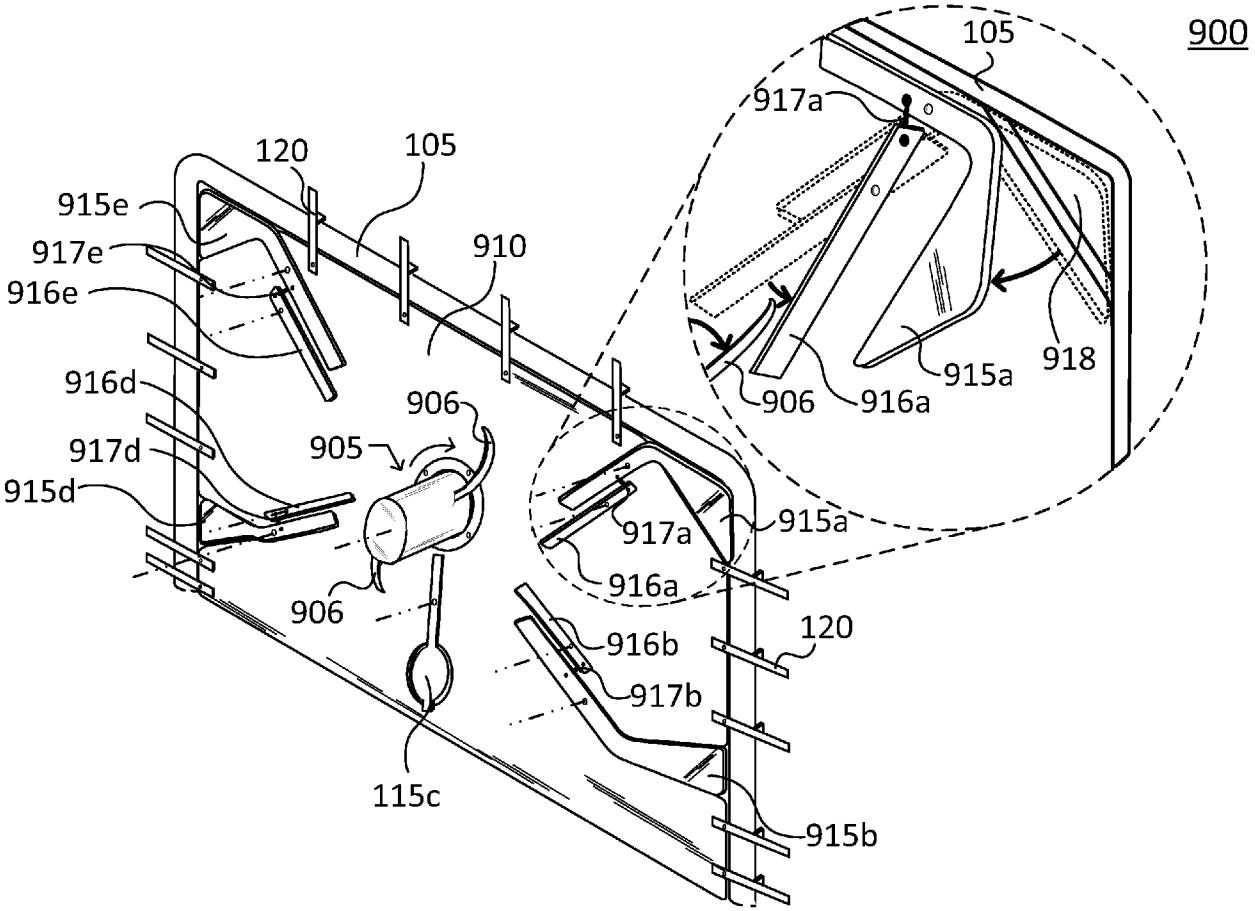
FIG. 9 illustrates a perspective isometric view of a goal training apparatus according to another embodiment of this disclosure, generally viewed from a back side.

FIG. 9 illustrates a perspective isometric view of a goal training apparatus 900, according to another embodiment of this disclosure. As shown, goal training apparatus 900 is generally viewed from its backside and includes a single panel 910. Panel 910, similar to front panel 110 and back panel 710, is releasably coupled to goal frame 105 using one or more fasteners 120 (e.g., straps, etc.). Panel 910 is preferably mounted along and/or in front of an entrance plane to the goal and forms a barrier to the entrance plane of the goal. Panel 910 also defines one or more apertures or openings, which (as shown) are blocked or obstructed by a corresponding door assembly, which includes a door 915 coupled to a lever 916 by a link 917. Doors 915 include doors 915*a*, 915*b*, 115*c*, 915*d*, and 915*e*, levers 916 include levers 916*a*, 916*b*, 916*d*, and 916*e*, and links include link 917*a*, 917*b*, 917*d*, 917*e*. In some embodiments, links 917*a-e* represent springs that help return the respective door to its closed position or an open position. Collectively, each door assembly is movable between an open position and a closed position (similar to doors 115), as discussed below.

Goal training apparatus 900 also provides a rotary assembly 905 that includes two arms 906 rotatable about a rotary assembly axis. Arms 906 are positioned and dimensioned so as to contact levers 916 of a corresponding door 915. In operation, and referring to the zoomed in portion shown in FIG. 9, door 915*a* is mounted to panel 910 proximate a respective aperture 918. Here aperture 918 is defined by panel 910 and represents an opening between panel 910 and goal frame 105 (e.g., an opening through an entrance plane of the goal). Arms 906 rotate about the rotary assembly axis and contact lever 916*a*, which is coupled to door 915*a* by link 917*a*. Lever 916*a* is also rotatable or movable about a lever-axis. The rotation of lever 916*a* is translated to door 915*a* through link 917*a*. As lever 916*a* rotates, it pulls on link 917*a*, thereby pulling a portion of door 915*a*, which causes door 915*a* to also rotate about its door axis. When door 915*a* rotates about its door axis it "opens" or moves away from aperture 918, which allows an object to pass through the entrance plane of the goal. When the arm 906 ceases to contact lever 916*a*, door 915*a* rotates about its door axis and "closes" or blocks aperture 918. Typically, door 915*a* closes due to a counterbalance or a weight ratio about its axis pivot point. That is, door 915*a* may include portions having a mass that forces door 915*a* into a closed position at rest. In some embodiments, link 917*a* and/or lever 916*a* may likewise include a counterbalance mass. Alternatively (or in addition), a spring may be used to return doors 915 to respective closed positions at rest (e.g., when not contacted by one of arms 906).

It is also appreciated that levers 916, links 917, and/or doors 915 can include certain weight ratios, counter balances, and/or springs such that doors 915 remain in the open position at rest. In such embodiments, rotation and contact by arm 906 may cause a corresponding door 915 to close or block its respective aperture and return to an open position thereafter. In addition, each arm 906 may be independently movable about the axis the rotary assembly axis and/or may be configured to rotate at varying relative speeds depending on, for example, a gear ratio of gears coupled to respective arms, separate motor 405M, or the like.

Figure 10:
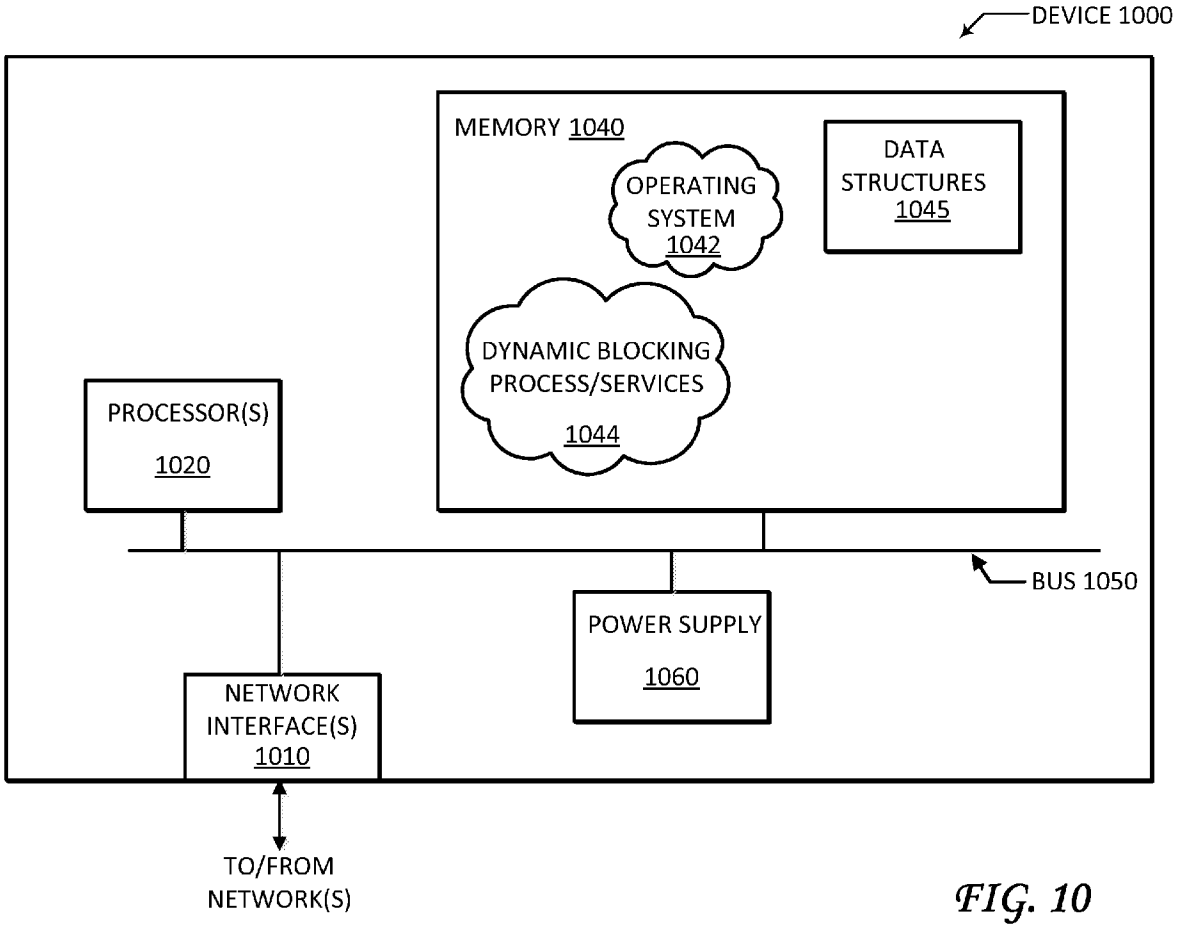
FIG. 10 illustrates a schematic block diagram of an example processing device that operatively controls the dynamic goal blocking operations.

FIG. 10 illustrates a schematic block diagram of an example processing device 1000 that operatively controls the dynamic goal blocking operations discussed herein. Device 1000 may comprise one or more network interfaces 1010 (e.g., wired, wireless, etc.), at least one processor 1020, and a memory 1040 interconnected by a system bus 1050, as well as a power supply 1060 (e.g., battery, plug-in, etc.).

The network interface(s) 1010 contain the mechanical, electrical, and signaling circuitry for communicating data over links coupled to a communication network. The network interfaces may be configured to transmit and/or receive data using a variety of different communication protocols. In addition, some devices may have two different types of network connections 1010, e.g., wireless and wired/physical connections, and that the view herein is merely for illustration.

Memory 1040 comprises a plurality of storage locations that are addressable by processor 1020 and network interfaces 1010 for storing software programs and data structures associated with the embodiments described herein. The processor 1020 may comprise hardware elements or hardware logic adapted to execute the software programs and manipulate the data structures 1045. An operating system 1042, portions of which are typically resident in memory 1040 and executed by the processor, functionally organizes the device by, inter alia, invoking operations in support of software processes and/or services executing on the device. These software processes and/or services may comprise a dynamic blocking process/services 1044, as described herein.

It will be apparent to those skilled in the art that other processor and memory types, including various computer-readable media, may be used to store and execute program instructions pertaining to the techniques described herein. Also, while the description illustrates various processes, it is expressly contemplated that various processes may be embodied as modules configured to operate in accordance with the techniques herein (e.g., according to the functionality of a similar process). Further, while the processes have been shown separately, those skilled in the art will appreciate that processes may be routines or modules within other processes.

Dynamic blocking process 1044 contains computer readable instructions executable by processor 1020. These instructions, when executed by the processor 1020, cause the processor to perform functions that operate and/or control a rotary assembly (e.g., motor) such as rotary assemblies 405, 905. These functions may, on capable devices, be configured to dynamically rotate arms for the respective rotary assembly on a particular schedule (pre-programmed, random, etc.). In addition, in some embodiments, the dynamic blocking process 1044 may also detect when an object passes through an aperture (e.g., detecting disruption of an IR light, etc.), keep track of points scored and/or statistics (e.g., regarding the total number of points, preferences for scoring through specific apertures, etc.), adjust a rotation rate of the motor based on a number of times or instances the object passes through the apertures in a time period (e.g., increase/decrease a level of difficulty or speed associated with the rotation rate, etc.), and the like.

Moreover, in other embodiments, device 1000 may operate in conjunction with a mobile device (e.g., a smart phone, tablet, etc.) over a wireless communication network. In such embodiments, the smart phone may include an application that provides a user interface and allows a user to set a schedule for opening/closing doors on the a goal training apparatuses/devices discussed herein. In addition, device 1000 can communicate the points scored, statistics, the rotation rate, and other metrics to the mobile device for subsequent display.

Further, it is expressly contemplated that the dynamic blocking process/services described herein can be implemented as software being stored on a tangible (non-transitory) computer-readable medium, devices, and memories (e.g., disks/CDs/RAM/EEPROM/etc.) having program instructions executing on a computer, hardware, firmware, or a combination thereof. Further, methods describing the various functions and techniques described herein can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on. In addition, devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example. Instructions, media for conveying such instructions, computing resources for executing them, and other structures for supporting such computing resources are means for providing the functions described in these disclosures.

The devices, apparatus, and techniques described herein, therefore, provide a goal training aid that simulates the dynamic nature of live game situations by opening and closing doors to permit/prohibit access by an object (e.g., a puck, ball, etc.) through an entrance plane of the goal. The techniques described herein are particularly applicable for any sport that that awards points when an object (e.g., a puck, ball, etc.) pass through an opening of a goal. By way of non-limiting examples, the devices described herein are readily adaptable for sports such as hockey (ice, roller, street, etc.), lacrosse, water polo, basketball, soccer (or futbol), field hockey, and the like.

While there have been shown and described illustrative embodiments that provide a dynamic goal training apparatus/aid, it is to be understood that various other adaptations and modifications may be made within the spirit and scope of the embodiments herein. For example, the embodiments have been shown and described herein with relation to a hockey net. However, the embodiments in their broader sense are not as limited, and may, in fact, be used with any number of sports, as discussed above. Moreover, while certain embodiments are shown and described as having certain features or aspects, such features or aspects may be interchangeable included (or excluded) from any of the embodiments disclosed herein.

The foregoing description has been directed to specific embodiments. It will be apparent, however, that other variations and modifications may be made to the described embodiments, with the attainment of some or all of their advantages. Accordingly this description is to be taken only by way of example and not to otherwise limit the scope of the embodiments herein. Therefore, it is the object of the appended claims to cover all such variations and modifications as come within the true spirit and scope of the embodiments herein.

The invention claimed is:

1. A training apparatus, comprising:

a panel that forms an obstruction proximate an entrance plane of a goal frame, the panel defines one or more aperture that permit an object to through the entrance plane of the goal;

a rotary assembly coupled to the panel, the rotary assembly having an axis of rotation and at least one arm that rotates about the axis of rotation; and one or more door in operable communication with the at least one arm, the one or more door located proximate a respective aperture of the one or more apertures and is moveable between a closed position to prevent passage of the object through the respective aperture and an open position to permit passage of the object through the respective aperture;

wherein the panel is a first panel and a second panel coupled together, and the one or more aperture is a first plurality of apertures formed on the first panel, and a second plurality of apertures formed in the second panel and corresponding to the first plurality of apertures which permit passes of an object therethrough, wherein the one or more door is disposed between the first panel and the second panel.

2. The training apparatus of claim 1, wherein the rotary assembly further comprises:

a processor that controls at least one of a rate or a direction of rotation.

3. The training apparatus of claim 1, further comprising:

one or more fasteners releasably secure the panel to the goal frame.

4. The training apparatus of claim 3, wherein at least one fastener obstruct a portion of at least one aperture.

5. The training apparatus of claim 3, wherein at least one fastener prevents flexion of the one or more doors.

6. The training apparatus of claim 1, wherein a portion of the panel forms an interlace pattern proximate the one or more aperture to prevent flexion of the one or more door.

7. The training apparatus of claim 1, wherein at least one door of the one or more door includes a counterbalance that facilitates movement between the closed position and the open position.

8. The training apparatus of claim 1, further comprising:

at least one spring in operable communication with the one or more door, the at least one spring facilitates movement of the the one or more door between the closed position and the open position.

9. The training apparatus of claim 1, wherein the at least one arm of the rotary assembly extends perpendicular to the axis of rotation and substantially parallel to the entrance plane of the goal.

10. The training apparatus of claim 1, wherein the at least one arm comprises at least two arms, each of the at least two arms rotate about the axis of rotation.

11. The training apparatus of claim 10, wherein each of the at least two arms independently rotates about the axis of rotation.

12. The training apparatus of claim 10, further comprising:

a motor coupled to the rotary assembly, wherein the motor is in communication with each of the at least two arms by a respective gear, and rotates each of the at least two arms about the axis of rotation at different relative speed based on a gear ratio between each respective gear.

13. The training apparatus of claim 1, further comprising:

at least one lever in operable communication with the one or more door, the lever rotates about a lever-axis and transfers motion from the at least one arm to the one or more door to cause the one or more door to move between the closed position and the open position.

14. The training apparatus of claim 13, further comprising a link coupled to the at least one lever and the one or more door, the link facilitates a transfer of motion from the at least one arm to the one or more door.

15. The training apparatus of claim 1, further comprising:

a motor coupled to the rotary assembly, the motor controls a rotation rate of the at least one arm about the axis of rotation;

a processor in operable communication with the motor; and a memory configured to store instructions executable by the processor, the instructions, when executed by the processor, is operable to:

instruct the motor to adjust the rotation rate based on at least one of a user input, a pre-programmed sequence, or a random number.

16. The training apparatus of claim 15, wherein the instructions, when executed by the processor, is further operable to:

detect a number of instances the object passes through the one or more aperture over a time period, and wherein the process to instruct the motor further comprises instruct the motor to adjust the rotation rate based on at least one of a user input, a pre-programmed sequence, a random number, or the number of instances.

17. The training apparatus of claim 1, wherein the goal frame is selected from the group consisting of a hockey goal, a soccer goal, a basketball goal, a water polo goal, a field hockey goal, or a lacrosse goal.

18. The training apparatus of claim 1, wherein the panel defines at least one aperture with respect to the goal frame.

19. The training apparatus of claim 1, wherein the one or more door includes a counterbalance to cause the one or more door to rest in one of the closed position or the open position.

* * * * *